US007374528B2

(12) United States Patent
Yoder, IV et al.

(10) Patent No.: US 7,374,528 B2
(45) Date of Patent: May 20, 2008

(54) AIR EVACUATION SYSTEMS AND METHODS FOR LINING A CONTAINER

(75) Inventors: John Thomas Yoder, IV, Dakota Dunes, SD (US); Thomas D. Graham, Winter Garden, FL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 48 days.

(21) Appl. No.: 11/133,124

(22) Filed: May 19, 2005

(65) Prior Publication Data

US 2006/0264309 A1 Nov. 23, 2006

(51) Int. Cl.
*B31B 7/78* (2006.01)

(52) U.S. Cl. ..... 493/101; 493/313

(58) Field of Classification Search ..... 493/93, 493/100, 101, 104, 192, 217, 313; 53/386.1, 53/449, 170, 175; 141/140
See application file for complete search history.

(56) References Cited

U.S. PATENT DOCUMENTS

| | | | | |
|---|---|---|---|---|
| 2,328,798 | A * | 9/1943 | Gardner | 156/160 |
| 2,364,012 | A * | 11/1944 | Walton et al. | 229/117.28 |
| 2,736,065 | A * | 2/1956 | Wilcox | 156/160 |
| 3,169,355 | A * | 2/1965 | Hollaway et al. | 53/88 |
| 3,195,425 | A * | 7/1965 | Taggart | 493/95 |
| 3,366,019 | A * | 1/1968 | McGee | 493/85 |
| 3,463,059 | A * | 8/1969 | Vonk | 493/294 |
| 4,052,931 | A | 10/1977 | Morse et al. | |
| 4,363,617 | A * | 12/1982 | Hirsekorn | 425/388 |
| 4,537,584 | A | 8/1985 | Everman et al. | |
| 4,671,733 | A * | 6/1987 | Krein | 414/809 |
| 4,890,760 | A * | 1/1990 | Nicoll et al. | 220/495.04 |
| 5,028,197 | A | 7/1991 | Krein et al. | |
| 5,735,786 | A | 4/1998 | Krueger et al. | |
| 6,132,350 | A | 10/2000 | Krueger et al. | |
| 6,773,385 | B2 | 8/2004 | Johnson et al. | |
| 2005/0028494 | A1 * | 2/2005 | Higer et al. | 53/512 |

* cited by examiner

*Primary Examiner*—Paul Durand
(74) *Attorney, Agent, or Firm*—Armstrong Teasdale LLP

(57) ABSTRACT

An air evacuation system is used for lining a container with a flexible liner. The container has a plurality of walls defining a cavity with an open top, and each wall has an interior surface and an exterior surface. The air evacuation system includes a platform for supporting the container in a formed state, wherein the container has the liner in an unseated position within the cavity. A vacuum assembly is coupled to the platform. The vacuum assembly includes a pump in airflow communication with at least one inlet positioned adjacent to the exterior surface of a first container wall. The vacuum assembly is configured to draw air using the at least one inlet from the cavity through the first container wall such that the liner is positioned substantially adjacent to the interior surface of the container in a seated position.

17 Claims, 5 Drawing Sheets

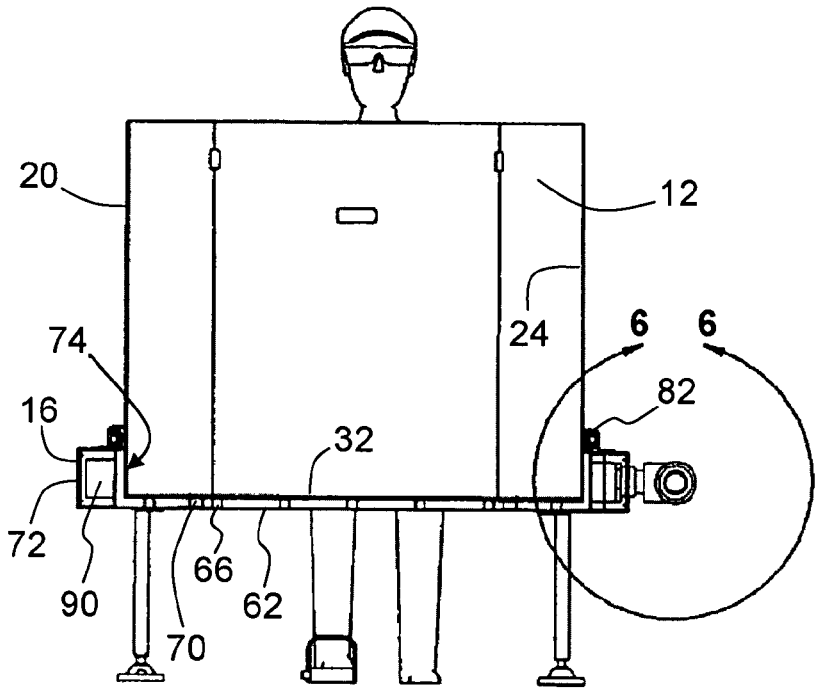
FIG. 5
FIG. 6
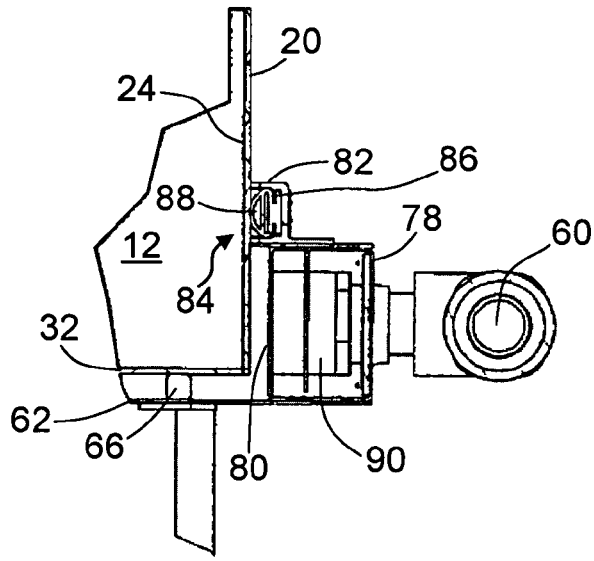

AIR EVACUATION SYSTEMS AND METHODS FOR LINING A CONTAINER

BACKGROUND OF THE INVENTION

This invention relates generally to air evacuation systems and methods for lining a container, and more particularly, to air evacuation systems and methods for lining a container with a flexible liner.

Many businesses package products or waste materials before shipping the products or materials to other locations. Specifically, these businesses package the products or materials into containers for shipping and transportation. In at least some of these cases, the products or materials are packaged in containers lined with a flexible or plastic liner to reduce spoiling or spillage of the products or materials. For example, a corrugated container lined with a plastic liner may be used for shipping certain products or materials wherein the plastic liner is utilized to reduce spoilage of the products or leakage of the products through the corrugated container.

In at least some known applications of placing a flexible liner within a container, an operator will manually erect the container and then position the liner by hand within the container. This process can be time consuming and result in increased labor costs. Moreover, in at least some cases, the operator may fail to properly position the liner within the container (e.g., fully opening and expanding the liner within the container), which may result in reducing the amount of actual materials that can be loaded into the container or may result in damage to the liner when loading the materials into the container. In fact, in at least some know cases, an improperly positioned liner within a container may result in the liner being punctured during the loading of the material into the container, and thus, allowing the materials to spoil or leak through the container.

In response to the additional labor costs and improper positioning of a liner within a container, at least some known machines have been developed to aid in the lining of such containers. At least some known machines automate the lining process by physically placing the liner within the container. However, these machines require complex mechanical features and components. Specifically, mechanical arms are used to place the liner into the container along the sides and bottom walls of the container. At least some other known machines automate the lining process by placing the liner along the top of the container and blowing the liner into the container. At least some other known machines automate the lining process by removing the air between the liner and the container to draw the liner against the interior of the container. At least one of these known machines positions a vacuum plenum beneath an opened bottom portion of the container, and pulls the air from the container cavity through the open bottom portion of the container. However, because the container is formed after the liner is positioned within the container, the liner is not fully seated against the interior surfaces of the container.

BRIEF DESCRIPTION OF THE INVENTION

In one aspect, an air evacuation system is provided for lining a container with a flexible liner. The container has a plurality of walls defining a cavity with an open top, and each wall has an interior surface and an exterior surface. The air evacuation system includes a platform for supporting the container in a formed state, wherein the container has the liner in an unseated position within the cavity. A vacuum assembly is coupled to the platform. The vacuum assembly includes a pump in airflow communication with at least one inlet positioned adjacent to the exterior surface of a first container wall. The vacuum assembly is configured to draw air using the at least one inlet from the cavity through the first container wall such that the liner is positioned substantially adjacent to the interior surface of the container in a seated position.

In another aspect, an air evacuation apparatus is provided for positioning a flexible liner within a container. The container has a plurality of walls defining a cavity, and each wall has an interior surface and an exterior surface. The air evacuation apparatus includes a platform having a base for supporting the container in a formed state and a plurality of side rails for aligning the container with respect to said platform. The container includes the liner in an unseated position within the cavity. A suction member is coupled to the platform and is configured to position the unseated liner in a seated position adjacent the interior surface of the container by drawing air from the container cavity through at least one container wall such that substantially all of the air between the interior surface of the container and the unseated liner is removed.

In a further aspect, a method of lining a container with a flexible liner using an air evacuation system is provided. The container has a plurality of walls defining a cavity with an open top, and each wall has an interior surface and an exterior surface. The air evacuation system includes a platform for supporting the container and a vacuum assembly coupled to the platform. The method includes forming the container, positioning the container on the platform, and positioning the liner at least partially within the container cavity, wherein the liner is in an unseated position. The method also includes operating the vacuum assembly to create a vacuum around at least a portion of the container to draw air from the container cavity through at least one container wall such that the liner is positioned adjacent the interior surface of the container in a seated position.

BRIEF DESCRIPTION OF THE DRAWINGS

FIG. 5 is a cross sectional view of the air evacuation system taken along line 5-5 in FIG. 1 with the container positioned therein.

FIG. 6 is a cross sectional view of a portion of the air evacuation system and the container and taken along area 6-6 in FIG. 5.

DETAILED DESCRIPTION OF THE INVENTION

Figure 1:
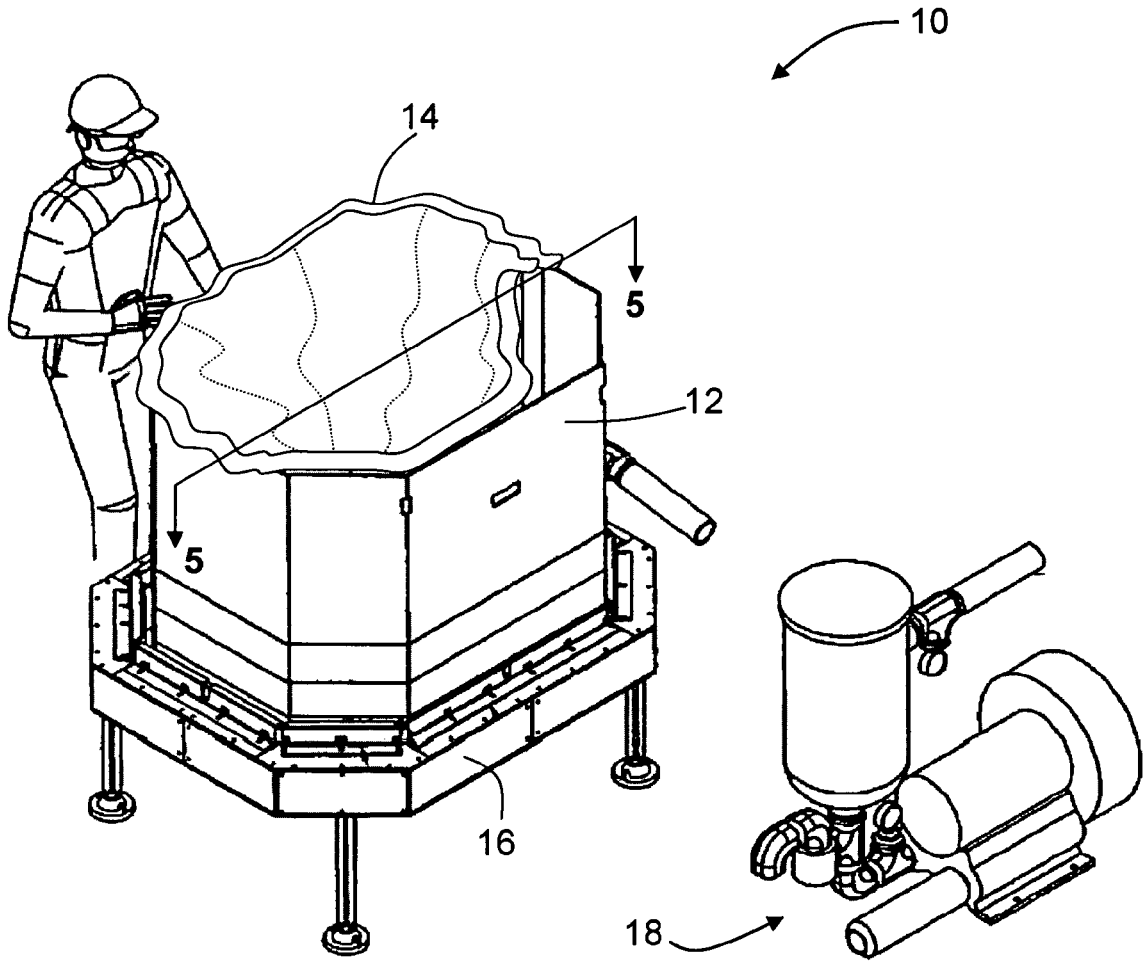
FIG. 1 is a perspective view of an air evacuation system for lining a container with a liner.

FIG. 1 is a perspective view of an air evacuation system 10 for lining a container or bin 12 with a flexible, bag-like liner 14. Air evacuation system 10 includes a platform 16 for supporting container 12, and a vacuum assembly 18. In an exemplary embodiment, vacuum assembly 18 is positioned adjacent to container 12 for removing excess air between liner 14 and container 12, thus eliminating the risk of liner 14 tears when loading a product into container 12. Additionally, vacuum assembly 18 facilitates automated lining of container 12 with liner 14 in a reduced time as compared to manual lining of container 12 with liner 14. Specifically, liner 14 is transferred from an unseated position, as illustrated in FIG. 1, to a fully seated position, substantially filling container 12, with the use of air evacuation system 10.

Figure 2:
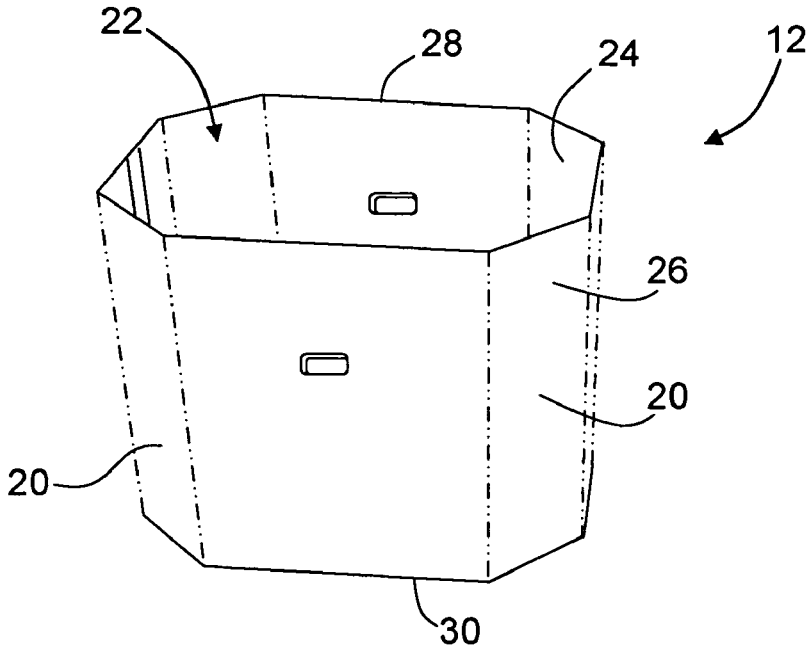
FIG. 2 is a top perspective view of the container shown in FIG. 1.
Figure 3:
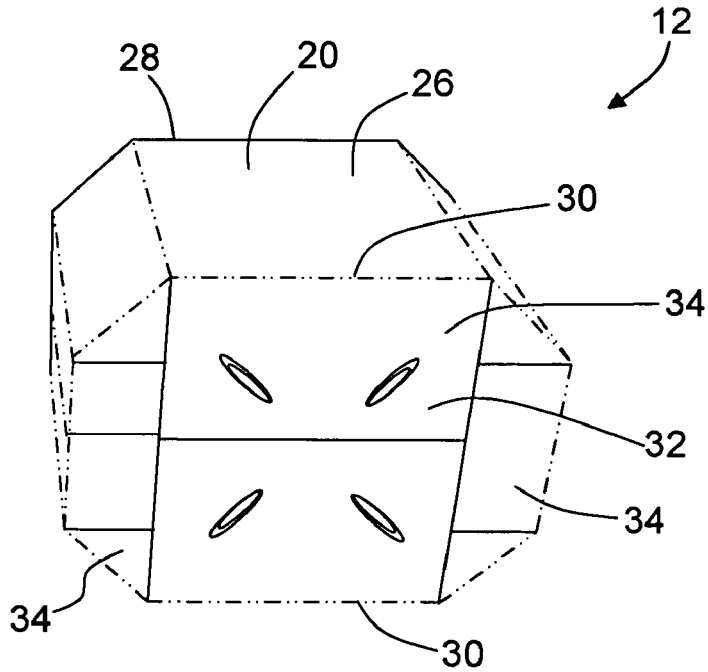
FIG. 3 is a bottom perspective view of the container shown in FIGS. 1 and 2.

FIGS. 2 and 3 are top and bottom perspective views, respectively, of container 12. Container 12 includes a plurality of walls or panels 20 defining a container cavity 22. In one embodiment, container walls 20 are fabricated from a porous or semi-porous material, such as a corrugated paperboard material, which allows air to flow therethrough. Walls 20 are connected to one another along fold lines and, during forming of container 12, at least two walls 20 overlap one another to form a seam. In an exemplary embodiment, container 12 includes eight walls 20 having an octagonal shape defining the sides of container 12. However, in alternative embodiments, container 12 includes more or less than eight side walls 20, and container 12 has another regular or irregular shape, such as, for example, square, rectangular, triangular, curvilinear, or the like.

Each wall 20 defining the sides of container 12 includes an inner surface 24 and an outer surface 26, and extends between a top edge 28 and a bottom edge 30. In an exemplary embodiment, container 12 is open to cavity 22 at top edge 28 and is closed to define cavity 22 at a bottom wall 32. As such, bottom wall 32 and walls 20 defining the sides of container 12 are collectively referred to as container walls. In one embodiment, bottom wall 32 is defined by a plurality of flaps 34. Each flap 34 is connected to a respective bottom edge 30 of each wall 20 at a fold line. During forming, flaps 34 are secured or coupled together using a mechanical feature, such as a retaining slot, or a chemical bond, such as an adhesive. Once assembled and formed, container 12 receives liner 14 (shown in FIG. 1), liner 14 is transferred from an unseated position to a seated position within container 12, and container 12 is filled with a product. In one embodiment, container 12 defines a bulk bin for housing waste material, such as waste material from a meat packaging plant. However, the use of container 12 is in no way limited to housing waste material. Once container 12 is filled with the product, a cover or lid (not shown) may be secured or otherwise placed over the open top of container 12, thus encasing the contents within container 12.

Figure 4:
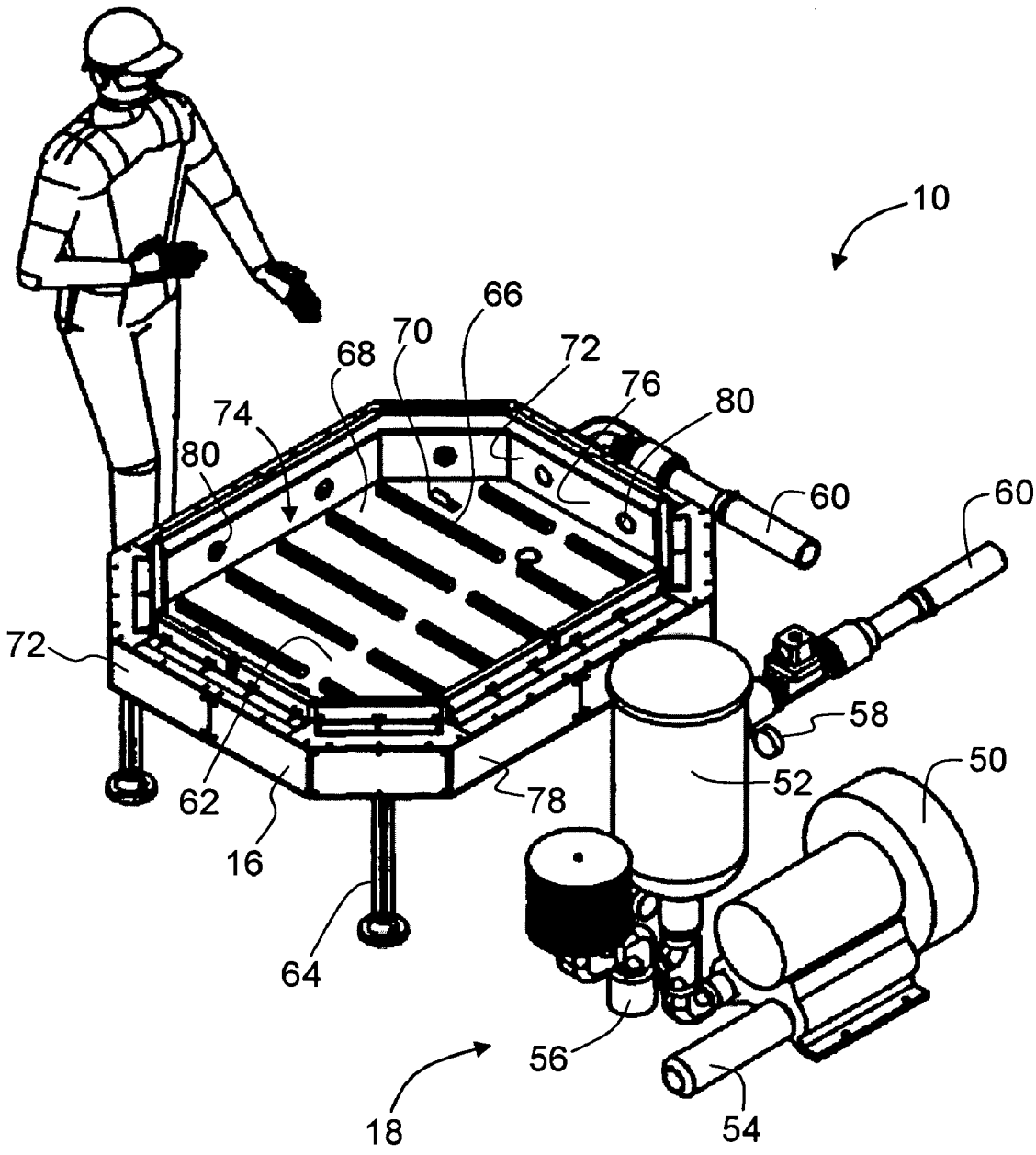
FIG. 4 is a top perspective view of the air evacuation system shown in FIG. 1 with the container removed for clarity.

FIG. 4 is a top perspective view of air evacuation system 10 with container 12 (shown in FIGS. 1-3) removed for clarity. Air evacuation system 10 includes vacuum assembly 18. In an exemplary embodiment, vacuum assembly 18 is a mechanical device that facilitates creating a suction or vacuum for drawing air through air evacuation system 10. In one embodiment, vacuum assembly 18 includes a pump or a blower 50 having a motor (not shown) for creating the vacuum. Vacuum assembly 18 also includes a filter 52 and a muffler 54. In one embodiment, vacuum assembly 18 includes a release valve 56 and a pressure gauge 58. Additionally, vacuum assembly 18 includes a plurality of tubes or hoses 60 coupled between pump 50 and platform 16.

Platform 16 includes a base 62 supported by a plurality of support legs 64. In an exemplary embodiment, base 62 is substantially planar and has a similar shape as container 12 (shown in FIG. 1). Base 62 is used to support container 12 when container 12 is positioned within or on platform 16. Base 62 includes a plurality of protrusions or ribs 66 raised from an upper surface 68 of base 62. As explained below in detail, ribs 66 provide an air gap or void between container bottom wall 32 and base 62. As such, a vacuum may be created between container 12 and base 62. Moreover, ribs 66 facilitate retaining container 12 in a formed state. Additionally, base 62 includes spacer tabs 70 extending from upper surface 68. Spacer tabs 70 protrude further than ribs 66 and engage container bottom wall 32 when positioned on base 62. Specifically, each spacer tabs 70 engages at least one flap 34 (shown in FIG. 3) of container 12 and displaces the respective flap 34 generally toward container cavity 22. As such, spacer tabs 70 facilitate creating an air gap or void between adjacent flaps 34 thus increasing an amount of air evacuated form container cavity 22 in addition to air evacuated through container walls 20 and 32.

Platform 16 also includes a plurality of side rails 72 defining a recess 74 for receiving container 12 therein. When installed, container walls 20 are positioned adjacent platform side rails 72, and in an exemplary embodiment, engage at least a portion of platform side rails 72. As a result, container 12 is positioned or aligned within platform 16, and retained in place for the air evacuation process by vacuum assembly 18. In an exemplary embodiment, each side rail 72 has an interior and an exterior surface 76 and 78, respectively. Vacuum tube 60 is coupled to exterior surface 78 such that vacuum assembly 18 is in airflow communication with platform 16. Moreover, interior surfaces 76 of each side rail 72 include air inlets 80 in airflow communication with vacuum tube 60. Specifically, and as will be described in detail below, side rails 72 have an internal channel (not shown) which communicates with inlets 80 and tube 60. As such, during operation, air is drawn through inlets 80, internal channel, and vacuum tube 60 by vacuum assembly 18. Additionally, each air inlet 80 is in airflow communication with recess 74. As a result, air within recess 74 is evacuated by vacuum assembly 18.

FIG. 5 is a cross sectional view of air evacuation system 10 taken along line 5-5 in FIG. 1 with container 12 positioned within platform 16. FIG. 6 is a cross sectional view of a portion of air evacuation system 10 and container 12 and taken along area 6-6 in FIG. 5. In an exemplary embodiment, as illustrated in FIGS. 5 and 6, formed container 12 is arranged within platform 16. Specifically, bottom wall 32 of container 12 is seated upon base 62, and more particularly, ribs 66 and/or spacer tabs 70. Additionally, container walls 20 are positioned adjacent platform side rails 72, and in one embodiment, have a friction or snug fit with respect to side rails 72. In an exemplary embodiment, container walls 20 have a friction or snug fit with a seal member 82.

Seal member 82, an embodiment of which is illustrated in FIG. 6, includes an inflatable bladder assembly 84. Bladder assembly 84 includes a frame 86 for supporting an inflatable bladder 88. In one embodiment, air is supplied to bladder 88 by an external air supply (not shown), and is released by a release valve (not shown). As bladder 88 is inflated, bladder 88 engages container walls 20 forming a seal completely around container 12. As a result, the vacuum created by vacuum assembly 18 and applied to container 12 can be maintained within recess 74, and particularly, within the air gap or void between container walls 20 and base 62 and/or side rails 72 of platform 16. In an alternative embodiment, seal member 82 is moveable toward and away from container 12 such that, when container 12 is positioned within platform 16, seal member 82 is moved toward container 12 until a seal is formed around container 12, and seal member 82 is moved away from container 12 to allow container 12 to be removed from platform 16. For example, seal member 82 is on glides (not shown) such that seal member 82 is moveable.

As further illustrated in FIGS. 5 and 6, vacuum tube 60 is coupled to exterior surface 78 of side rails 72 such that vacuum assembly 18 is in airflow communication with internal channel 90. Internal channel 90 extends entirely around platform 16 and communicates with the plurality of inlets 80 extending through internal surface 76 of platform side rails 72. As such, during operation, air is drawn from recess 74 through inlets 80, internal channel 90, and vacuum tube 60 by vacuum assembly 18. Moreover, air is drawn through container 12 when container 12 is positioned within platform 16.

In an exemplary embodiment, when operated, vacuum assembly 18 draws or sucks air from container cavity 22, through container walls 20, into recess 74. More specifically, vacuum assembly 18 draws the excess air located between inner surface 24 of container and liner 14. Additionally, vacuum assembly 18 then draws or sucks the air from recess 74, into air inlets 80, through internal channel 90 and vacuum tube 60. The air is then exhausted by blower 50 (shown in FIG. 4). As a result, when substantially all of the air is drawn from container cavity 22, liner 14 is positioned adjacent inner surface 24 of container 12. More specifically, liner 14 is eventually firmly seated against walls 20 and bottom wall 32 of container 12. As a result, the entire volume of container cavity 22 is available for receiving a product therein. Additionally, the risk of tearing liner 14 is reduced as the liner is firmly seated against inner surface 24 of container 12. Moreover, liner 14 is positioned automatically and without the need of operator assistance.

Figure 7:
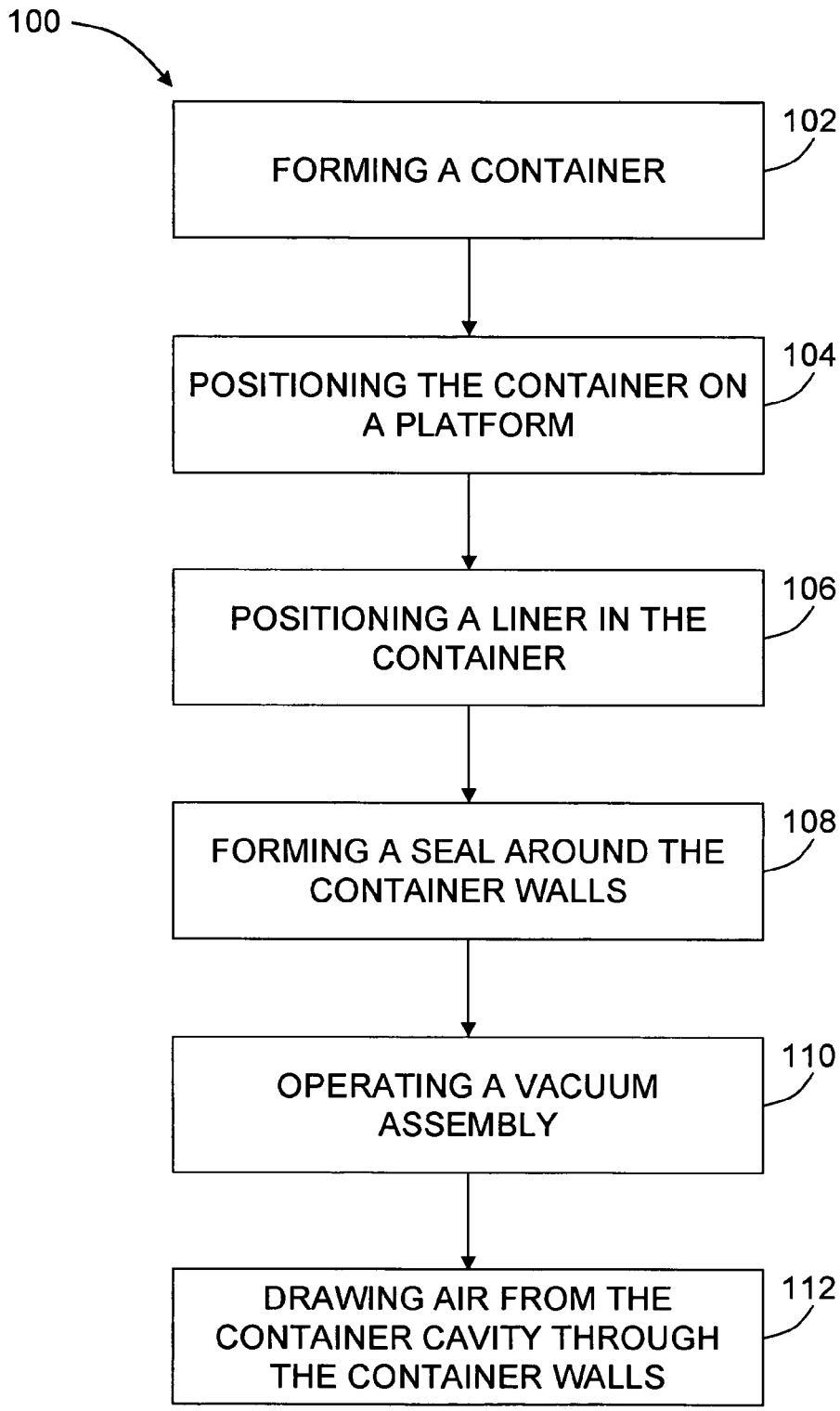
FIG. 7 is a flow chart identifying an exemplary method of using the air evacuation system shown in FIG. 1.

FIG. 7 is a flow chart identifying an exemplary method of lining 100 container 12 with flexible liner 14 using air evacuation system 10. In an exemplary embodiment, the method of lining 100 includes forming 102 container 12, and positioning 104 container 12 on platform 16. As indicated above, container 12 is formed from side walls 20 and bottom wall 32. Container 12 is erected into a predetermined shape, such as the octagonal shape illustrated in FIG. 1, having an open top.

Once formed, container 12 is positioned 104 on platform 16 such that bottom wall 32 engages base 62, and more particularly, engages ribs 66 and/or spacer tabs 70. As such, a gap or void is created between container bottom wall 32 and upper surface 68 of base 62. Moreover, container 12 is positioned 104 on platform 16 such that container side walls 20 are positioned adjacent platform side rails 72. In one embodiment, a gap or void is positioned between container and platform side rails 20 and 72.

Once container 12 is positioned, liner 14 is positioned 106 at least partially within container cavity 22. As such, liner 14 is initially positioned in an unseated position. In one embodiment, an operator positions liner 14 partially within container cavity 22 and extends or cuffs liner 14 around top edge 28 of container side walls 20. Additionally, the operator may secure liner 14 around top edge 28 using, for example, a securing strap or another mechanical feature which retains liner 14 at top edge 28. Alternatively, the operator may hold liner 14 at top edge 28 during use of air evacuation system 10.

In lieu of the operator manually placing liner 14 in a seated position wherein liner 14 is seated against inner surface 24 of container walls 20 and 32, the operator operates air evacuation system 10. For example, once liner 14 is positioned within container 12, the operator forms 108 a seal around outer surfaces 26 of container walls 20 using seal member 82. In one embodiment, air evacuation system 10 includes inflatable bladder assembly 84, and operator inflates bladder 88 such that a seal is formed around a perimeter of container 12. In one embodiment, the seal is positioned proximate to bottom wall 32 such that air evacuation system draws air through a bottom portion, particularly bottom wall 32 and portions of side walls 20 adjacent bottom wall 32, of container 12.

Once the seal is formed around container 12, the operator operates 110 vacuum assembly 18. In one embodiment, the operator operates 110 vacuum assembly 18 using a foot switch. When activated, vacuum assembly 18 creates a vacuum to draw air therethrough. In operation, vacuum assembly 18 includes a vacuum pump 50 that facilitates creating the vacuum, and a plurality of vacuum tubes 60 in flow communication with vacuum pump 18 and platform 16. As such, air is drawn from the gap or void between container 12 and platform 16, through inlets 80 and internal channel 90 and into vacuum tubes 60. In one embodiment, the amount of air drawn through the individual air inlets 80 is varied by vacuum assembly 18 such that a differential air pressure is created within the gap or void and against the various side walls 20 and bottom wall 32 of container 12. The differential air pressure facilitates controlling the positioning of liner 14 within container 12 by varying the suction force within container 12.

Moreover, vacuum assembly 18 also draws 112 air from container cavity 22 into the gap or void between container 12 and platform 16. In one embodiment, air is drawn 112 through container side walls 20 and bottom wall 32. As such, the air is evacuated from container cavity 22. As the air is evacuated from container cavity 22, liner 14 is drawn into container cavity 22 and is eventually seated against inner surfaces 24 of container side walls and bottom wall 32. Particularly, substantially all of the air between liner 14 and inner surfaces 24 of container side walls and bottom wall 32 is evacuated such that liner 14 is positioned adjacent inner surfaces 24. As a result, the entire volume of container cavity 22 is available for receiving the product therein. Additionally, the risk of tearing liner 14 is reduced as liner 14 is firmly seated against inner surface 24 of container 12. Moreover, as indicated by the various steps of method 100, liner 14 is positioned automatically and without the need of operator assistance.

While the invention has been described in terms of various specific embodiments, those skilled in the art will recognize that the invention can be practiced with modification within the spirit and scope of the claims.

What is claimed is:

1. A method of lining a container with a flexible liner using an air evacuation system, the container having a plurality of side walls and a bottom wall that define a cavity with an open top, each wall having an interior surface and an exterior surface, the air evacuation system having a platform for supporting the container, wherein the platform includes a base having a plurality of ribs and at least one spacer tab protruding upwardly therefrom, the at least one spacer tab extending from the base a greater distance than the plurality of ribs, and a vacuum assembly coupled to the platform, said method comprising:

forming the container such that the bottom wall is substantially perpendicular to the plurality of side walls, wherein the bottom wall includes a plurality of bottom flaps;

positioning the container on the platform such that the bottom wall of the container is adjacent to the plurality of ribs and the at least one spacer tab protruding from the base, wherein the bottom wall of the container is elevated above the base by the plurality of ribs such that a gap is defined therebetween, and wherein the at least one spacer tab engages one of the plurality of bottom flaps and displaces at least a portion of the engaged bottom flap relative to at least one of the other bottom flaps creating an airflow channel between the cavity and the gap;

positioning the liner at least partially within the container cavity, the liner being in an unseated position; and operating the vacuum assembly to create a vacuum around at least a portion of the container to draw air from the container cavity through at least one container side wall, and through the bottom wall and the gap such that the liner is positioned adjacent the interior surface of the container in a seated position while maintaining the gap between the bottom wall of the container and the base of the platform.

2. A method in accordance with claim 1, wherein the air evacuation system includes an inflatable bladder assembly, said method further comprises inflating the bladder assembly to form a seal around the container walls.

3. A method in accordance with claim 1, wherein said operating the vacuum assembly comprises drawing air from the container cavity until the liner is seated against the interior surface of the container cavity.

4. A method in accordance with claim 1, wherein said operating the vacuum assembly comprises drawing air from the container cavity until substantially all of the air is removed between the interior surface of the container and the liner.

5. A method in accordance with claim 1, wherein said operating the vacuum assembly comprises apply a differential air pressure to said vacuum assembly to facilitate positioning the liner within the container.

6. An air evacuation system for lining a container with a flexible liner, the container having a plurality of side walls and a substantially perpendicular bottom wall that define a cavity with an open top when the container is in a formed state, each wall having an interior surface and an exterior surface, the bottom wall including a plurality of flaps, said air evacuation system comprising:

a platform for supporting the container in the formed state, the container including the liner in an unseated position within the cavity, wherein said platform comprises a base comprising a plurality of ribs and at least one spacer tab extending upwardly therefrom, said at least one spacer tab extending upwardly from said platform base a greater distance than said plurality of ribs, said plurality of ribs elevating the bottom wall of the container from said platform base creating a gap between the bottom wall of the container and said platform base, said at least one spacer tab positioned to engage one of the plurality of bottom flaps and displace at least a portion of the engaged bottom flap relative to at least one of the other bottom flaps creating an airflow channel between the cavity and the gap; and a vacuum assembly coupled to said platform, said vacuum assembly comprising a pump in airflow communication with at least one inlet positioned adjacent to the exterior surface of a first container side wall, said vacuum assembly configured to draw air using the at least one inlet from the cavity through the first container side wall, and through the bottom wall and the gap, such that the liner is positioned substantially adjacent to the interior surface of the container in a seated position while the gap between the bottom wall of the container and said platform base is maintained.

7. An air evacuation system in accordance with claim 6, further comprising a seal member coupled to said platform, said seal member configured to form a seal around the container to facilitate drawing air from the cavity through the first container wall.

8. An air evacuation system in accordance with claim 6, further comprising an inflatable bladder assembly coupled to said platform, said inflatable bladder assembly engaging the exterior surface of the container when inflated.

9. An air evacuation system in accordance with claim 8, further comprising a switch for activating at least one of said vacuum assembly and said inflatable bladder assembly.

10. An air evacuation system in accordance with claim 6, wherein the plurality of walls of the container includes a plurality of side walls and a plurality of flaps connected to each of the side walls, wherein the plurality of flaps define the bottom wall of the container, said at least one spacer tab engaging at least one of the flaps of the container and elevating the respective flap such that a gap is formed between the respective flap and an adjacent flap to facilitate increasing an amount of air evacuated from the container cavity by said vacuum assembly.

11. An air evacuation system in accordance with claim 6, wherein at least a portion of the unseated liner is secured to the open end of the container, and wherein said vacuum assembly draws air from between the unseated liner and the interior surface of the container cavity such that the liner is seated against the interior surface of the container cavity.

12. An air evacuation system in accordance with claim 6, wherein said vacuum assembly further comprises a plurality of inlets positioned adjacent to and at various locations surrounding the exterior surface of the container, said vacuum assembly configured to apply a differential air pressure to each of the plurality of inlets to facilitate positioning the liner within the container.

13. An air evacuation system in accordance with claim 6, wherein said platform comprises a base and a plurality of side walls, said platform side walls extending along at least a portion of the container walls, said at least one inlet coupled to at least one of said platform side walls.

14. An air evacuation apparatus for positioning a flexible liner within a container, the container having a plurality of side walls and a substantially perpendicular bottom wall that define a cavity when the container is in a formed state, each wall having an interior surface and an exterior surface, the bottom wall including a plurality of bottom flaps said air evacuation apparatus comprising:

a platform comprising a base for supporting the container in the formed state and a plurality of side rails for aligning the container with respect to said platform, the container including the liner in an unseated position within the cavity, wherein said base comprises a plurality of ribs and at least one spacer tab extending upwardly therefrom, said at least one spacer tab extending upwardly from said base a greater distance than said plurality of ribs, said plurality of ribs elevating the bottom wall of the container from said platform base creating a gap between the bottom wall of the container and said platform base, said at least one spacer tab positioned to engage one of the plurality of bottom flaps and displace at least a portion of the engaged bottom flap relative to at least one of the other bottom flaps creating an airflow channel between the cavity and the gap; and a suction member coupled to said platform and configured to position the unseated liner in a seated position adjacent the interior surface of the container by drawing air from the container cavity through at least one container side wall, and through said bottom wall and said gap, such that substantially all of the air between the interior surface of the container and the unseated liner is removed while the gap between the bottom wall of the container and the platform base is maintained.

15. An air evacuation apparatus in accordance with claim 14, further comprising an inflatable member coupled to said platform, said inflatable member engaging the exterior surface of the container when inflated forming a seal around the container.

16. An air evacuation apparatus in accordance with claim 14, wherein said suction member draws air from the container cavity such that the unseated liner is seated against the interior surface of the container cavity.

17. An air evacuation apparatus in accordance with claim 14, wherein said air evacuation apparatus comprises a plurality of suction members arranged along at least one of said plurality of side rails and said platform base, said air evacuation apparatus configured to apply a differential air pressure to each of said suction members to facilitate positioning the liner within the container.

* * * * *